US009221527B1

(12) United States Patent
Zeyger et al.

(10) Patent No.: US 9,221,527 B1
(45) Date of Patent: Dec. 29, 2015

(54) AQUATIC HAMMOCK

(71) Applicants: Eugene Zeyger, Medfield, MA (US); Lenny Senkovsky, Medfield, MA (US)

(72) Inventors: Eugene Zeyger, Medfield, MA (US); Lenny Senkovsky, Medfield, MA (US)

( * ) Notice: Subject to any disclaimer, the term of this patent is extended or adjusted under 35 U.S.C. 154(b) by 0 days.

(21) Appl. No.: 14/336,113

(22) Filed: Jul. 21, 2014

Related U.S. Application Data

(60) Provisional application No. 61/958,048, filed on Jul. 19, 2013.

(51) Int. Cl.
*B63B 35/76* (2006.01)
*A47C 15/00* (2006.01)

(52) U.S. Cl.
CPC ..... *B63B 35/76* (2013.01); *A47C 15/006* (2013.01)

(58) Field of Classification Search
CPC ..... B63B 35/73; B63B 35/76; B63B 35/74; B63B 7/08; A47C 15/006
See application file for complete search history.

(56) References Cited

U.S. PATENT DOCUMENTS

| | | | | |
|---|---|---|---|---|
| 3,618,940 | A * | 11/1971 | Manocherian | 472/114 |
| 4,953,849 | A * | 9/1990 | Reed | A63G 23/00 472/134 |
| 6,709,340 | B2 * | 3/2004 | Gordon | 472/134 |
| 7,052,344 | B1 * | 5/2006 | Peterson | 441/40 |
| 2010/0297900 | A1 * | 11/2010 | Zeyger | 441/129 |

* cited by examiner

*Primary Examiner* — Edwin Swinehart
(74) *Attorney, Agent, or Firm* — Lawrence G. Fridman, Esq.

(57) ABSTRACT

An aquatic hammock supporting a user and adapted to be placed on a surface of water includes a floating open-end body formed by a convex exterior wall and a concaved inner wall. First and second inflatable chambers are provided. The first inflatable chamber configured as a convex-concave shell extending between the convex exterior wall and the concaved inner wall. The second inflatable chamber is a tubular-shaped inflatable rim extending along an outer periphery of the floating body. A resting platform accommodating a user is supported by a top portion of the floating body and includes an ellipse-shaped frame with a fabric segment extending between sides of the frame. The hammock may be used not only on any open water surface, but also on any hard surface supporting a pool.

17 Claims, 5 Drawing Sheets

AQUATIC HAMMOCK

RELATED APPLICATIONS

This application claims priority of Provisional Patent Application No. 61/958,048 filed Jul. 19, 2013, wherein this Provisional Application is hereby incorporated in its entirety by reference.

FIELD OF THE INVENTION

The invention relates to recreational devices in general, and in particular it relates to flotation devices adapted for recreational play on water and/or land.

BACKGROUND OF THE INVENTION

Hammocks are well known recreational devices used to relax while swinging. It should be noted however, that the conventional hammocks can not be used independently and require additional items or equipment such as separate supports or spaced from each other trees for their operation.

There are also known floating loungers (examples shown in catalog (http://swimline.com/swimline/ilpflipcat/ilpcat-.pdf-page 6), but these loungers in their operation are disposed directly on a surface of water and cannot swing side-to-side, as often desired by a user.

In view of the above, it has been long felt an unsolved need to provide a flotation recreational device, such as an aquatic or floating hammock which can be used on any body of water such as a swimming pool, lake, ocean, etc., so it can be tilted and rocked in any direction from transverse to longitudinal.

Therefore, one main objective of the present invention is to provide a swinging hammock that floats and can be operated on any body of water.

It is another object of the invention to provide a fully integrated, simple to use, easily assembled, reliable water-swung hammock capable of being carried and stored easily, and of being used in a variety of ways for relaxation, and having effective, efficient, and reliable means for the attachment of components and auxiliary equipment.

It is a further object of the present invention to provide a floating hammock that swings by the natural movement of water.

It is still another object of the invention to provide an aquatic or floating hammock in an affordable, cost-effective form.

It is still further object of the invention to provide an aquatic or floating hammock in an easily dismantled, easily stored and transportable form.

It is a further object of the invention to provide leg supports and a detachable frame for an aquatic or floating hammock which are durable, effective, efficient and may be quickly, easily, and reliably assembled or broken down for storage.

SUMMARY OF THE INVENTION

One aspect of the invention provides an aquatic or floating hammock consisting of a buoyant open-end inflatable body having semispherical exterior surface having first and second inflatable chambers. The first inflatable chamber is in the form of a convex-concave shell-type body with a draining opening provided at the central portion thereof. The second chamber is an inflatable tubular rim surrounding an exterior of the first chamber. The hammock is formed with a resting platform adapted to accommodate a user and attached to the rim by means of a frame. The aquatic or floating hammock of the invention can be used on any body of water such as a swimming pool, lake, ocean, etc., and may be tilted and rocked in any direction from transverse to longitudinal. The hammock can be easily repositioned relative to sunlight or wind direction. In another application the hammock may also be used on land when placed in a small round pool with a semispherical bottom having a shape and size that are analogous to the buoyant body.

Another aspect of the invention provides the buoyant, semispherical open-end body having a tubular frame including a top substantially circular portion and radial spokes extending therefrom adapted to support an elastic cover.

A further aspect of the invention relates to the floating body placed within a pool having a semi-spherical bottom, wherein the pool is formed as a semi-spherical elastic base having a top circumferential portion.

BRIEF DESCRIPTION OF THE DRAWINGS

Referring now to the drawings which are provided to illustrate and not to limit the invention, wherein.

DETAILED DESCRIPTION OF THE INVENTION

For the purposes of clarity several terms which will be revisited later are here defined.

Metacenter is intersection of vertical lines through the center of buoyancy of a floating body when it is at equilibrium and when it is floating at an angle. The location of the metacenter is an indication of the stability of a floating body.

Center of gravity is the point at which the entire weight of a body may be considered as concentrated so that if supported at this point the body would remain in equilibrium in any position.

Figure 1:
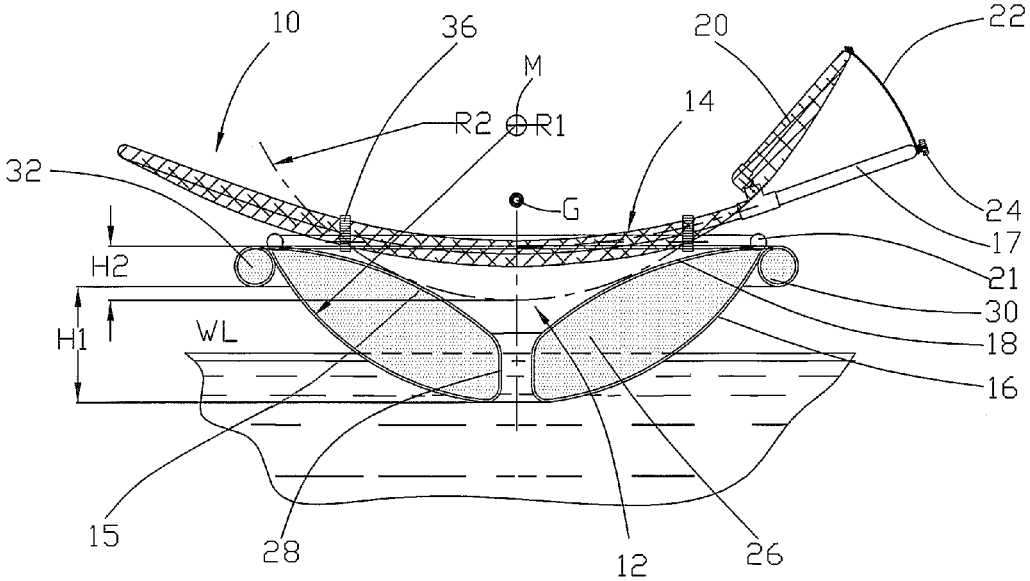
FIG. 1 is an elevation view showing the aquatic hammock of the invention floating on water.
Figure 2:
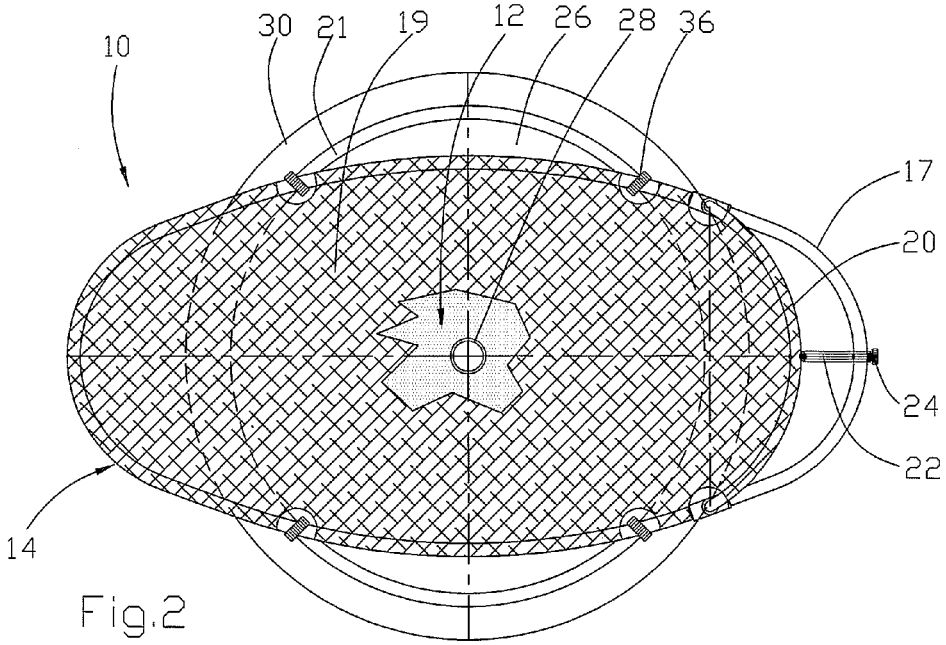
FIG. 2 is a top view of the aquatic hammock.

Referring now to the drawings in general and to FIGS. 1 and 2 in particular, which illustrate an aquatic or floating hammock arrangement 10 consisting of a floating body 12 supporting a resting platform 14 adapted to accommodate a user. In this embodiment various forms of the aquatic hammock are developed based on the body having a semi-spherical configuration. For example, in the embodiments of FIGS. 1-4 the floating body 12 is configured as a shell formed as a semi-spherical segment having concave-convex configuration. A convex exterior wall 16 is adapted to contact a surface of water, whereas a top part 15 of the concaved inner wall 18 provides support for the resting platform 14 and an operator. A rim 30 is disposed at the exterior top periphery of the body 12. A drain tube 28 passes though a central part of the body 12, providing direct connection between the convex exterior wall 16 and the concaved inner wall 18.

The resting platform 14 provided to support a user and is attached to the top part 15 of the body 12 (the inflatable rim 30) by any conventional arrangement, including clamps 36. As illustrated in at least FIGS. 1 and 2, the resting platform 14 is formed by a frame skeleton 17 having a shape of an ellipse, for example, with a mesh or fabric material segment 19 extending within and/or supported by the frame. An adjustable head rest 20 having a movable arm 22 and stop knob 24 extend outwardly from the frame 17. In this manner, an angular orientation/position of the head rest 20 with respect to the frame can be adjusted to accommodate requirements of a specific user. Multiple support clamps 36 secure the frame 17 and the resting platform to the load distributing member 21 and the top part of the body 12. This design enables a user to swing the body including the platform relative to the water surface.

To increase the buoyancy of the hammock 10, the floating body 12 is formed with the first and second inflatable chambers. The first inflatable chamber 26 is configured as a convex-concave shell, which extends between the convex exterior wall 16 and the concaved inner wall 18, with the drain tube 28 passing through the central portion thereof. The second inflatable chamber 32 is formed by the inflatable rim 30 configured as a tubular member extending along the outer periphery of the body 12. As illustrated in FIG. 1, substantially spherical exterior wall 15 has a curvature with radius R1 and height H1. The latter characteristic is a function of the weight of a user positioned within the floating hammock 10. The exterior wall 16 with greater radius R1 is adapted to accommodate a user with greater weight. This is because the center of gravity of the user "G" should be lower than the metacenter "M" which is a center of the sphere. When the radius R1 is predetermined, the height H1 defines the maximum weight of the user for a specific device. For example, when the weight of the user is 150 lbs. (70 kg), the outer shell submerges at the depth of one half of H1 and can be swung or moved side to side with inclination of 15°. When the weight is 200 lbs. (90 kg), the depth of submerging is about ¾ of H1, whereas the maximum of angle of inclination is about 5°. When the weight of the user is 300 lbs. (140 kg), the outer shell submerges at the entire depth of Ill. In this instance, swinging of the aquatic hammock is not recommended, since the tubular rim 30 practically touches the surface of water.

The inner wall 18 formed by a top area/surface of the first inflatable chamber 26 has a curvature with radius R2 and depth H2, which varies depending on the position of the user situated within the hammock 10. In this manner, the center of gravity of the user "G" is located as far as possible from the metacenter "M" of the body 12_disposed at the center of the sphere forming the shell of the body 12. The radius R2 is shown for illustrative purposes. When the first chamber 26 is inflated, it extends to the level identified by the curvature having the next radius R2. In this manner, the height H2 defines a surface of downward extension of the hammock under the weight of the person, so that it does not touch the top surface of the concaved inner wall 18, when the first chamber 26 is inflated.

When a user having specific weight is positioned on the resting platform 14, the floating body 12 submerges and a specific load water line "WL" is delineated at its exterior. In the embodiment where the floating body has a semispherical exterior, the load water line "WL" can be in the form of circumference corresponding to the level of displayed water supporting the floating body.

Although an inflatable structure of the body 12 has been discussed above, it should be noted that the body of the aquatic hammock of the invention having other designs is within the scope of the invention. For example, the body can be molded or otherwise made as a hollow structure from a rigid plastic or similar material.

The floating hammock 10, 12, while positioned on water at a level of the load water line "WL", can be tilted in a multiplicity of directions from transverse to longitudinal. The tilting range/angle of the hammock is limited by a position of the rim 30 with respect to the surface of water.

Figure 3:
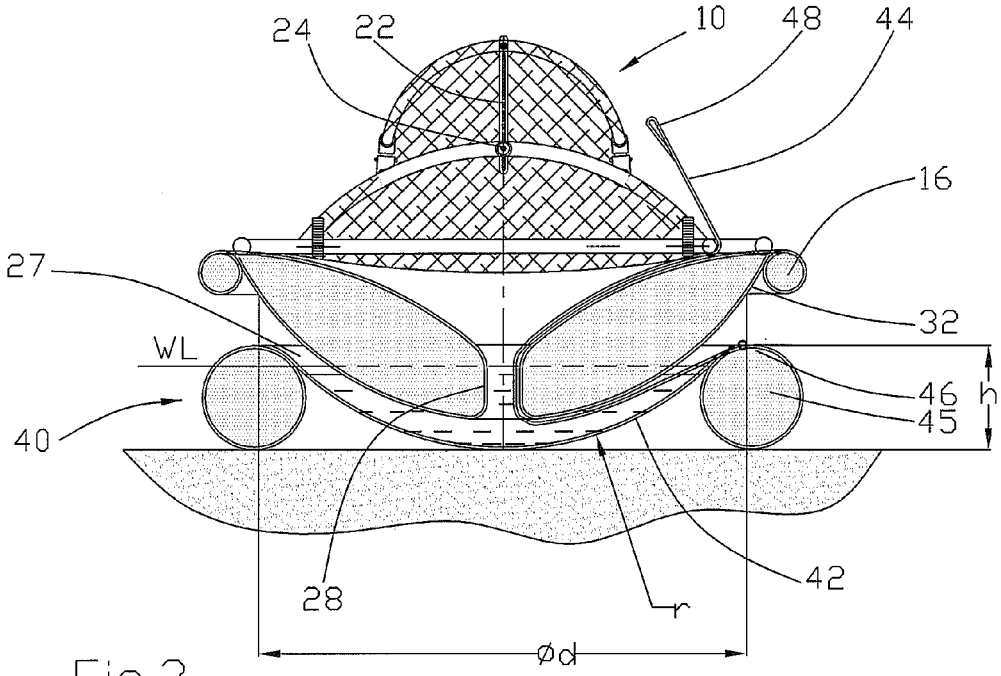
FIG. 3 is a side view of another embodiment of the invention showing the aquatic hammock positioned within a pool.
Figure 4:
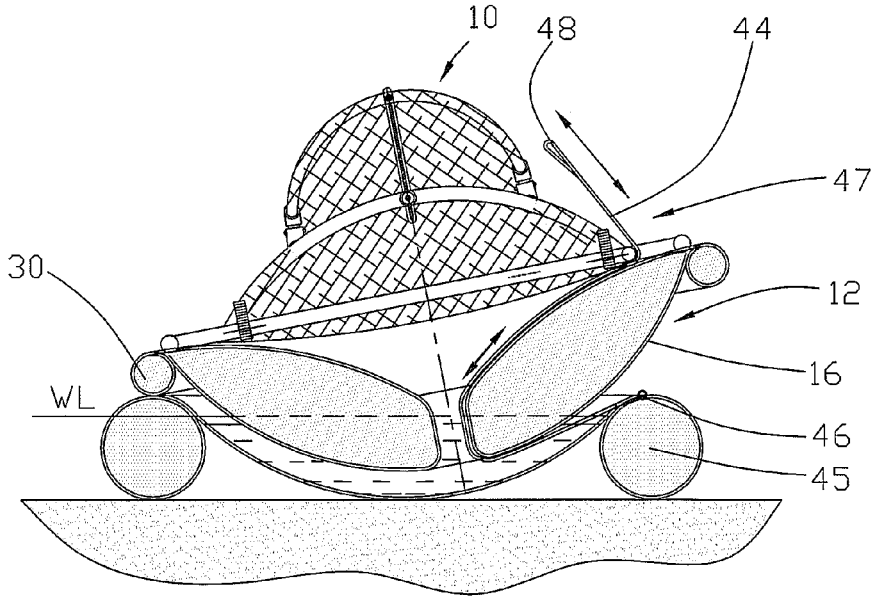
FIG. 4 is a side view showing the aquatic hammock of FIG. 3 in a tilted position.

As illustrated in FIGS. 3-4, in another embodiment of the invention the floating body 12 is placed within a semi-spherical pool 40, which is supported on the ground or on any other solid surface by a tubular member 45. The pool 40 is formed with a semispherical bottom 42 having curvature radius "r", diameter "d" and depth "h". These characteristics are similar to that of the exterior wall 16 of the body 12. The depth of the pool "h" is greater than the height of a portion of the floating body 12 submerged in to the water. The floating hammock is equipped with an adjusting arrangement for adjusting angular position/orientation of the floating body 12 relative to the pool 40. As illustrated in FIGS. 3 and 4 the adjusting arrangement 47 can be provided with a steering cable 44, having one end 46 connected to the pool 40 an another free end 48 available to an operator. The cable 44 passes through the drain tube 28 and engages at least a portion of the bottom area of the inflated body, the inner area of the drain tube 28 and a portion of the top area of the inflated body, so as to create a tilting leverage controlled by an operator. In use, an operator by pulling the free end 48 of the cable 44 is able to manipulate position/inclination of the floating body 12 within the pool 40. As illustrated in FIG. 4, the tilting orientation/angle of the body 12 is restricted by an interface between the rim 30 and the outer area of the pool 42. Although, the semi-spherical pool 40 supported by the tubular body 45 has been discussed above, it should be noted that any shape of the pool adapted to accommodate the swinging motion of the floating body 12 is within the scope of the invention.

As best illustrated in FIGS. 3 and 4, to facilitate swinging motion, the components of the hammock assembly are selected to have a gap 27 between the inner surface of the pool and the exterior wall of the a floating body 12. This gap 27 facilitates controllable motion of the body 12 within the inner space of the pool. However, the floating hammock of the invention is also operable in situations where the gap 27 is minimal. In this instance, a water layer between the exterior wall of the floating body and inner surface of the pool serves as a lubricant facilitating motion of the body.

Figure 5:
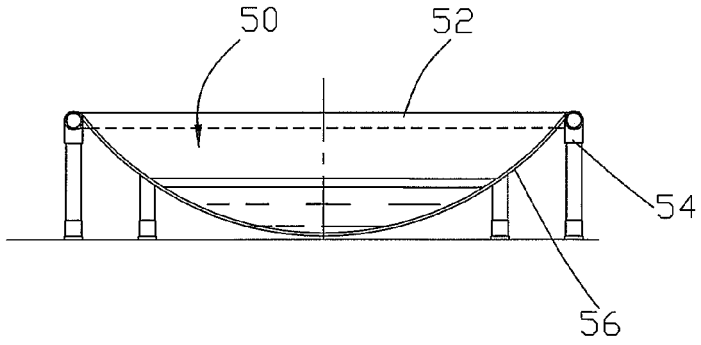
FIG. 5 is a cross sectional view showing an alternate design of the pool.

FIG. 5 illustrates another embodiment of the pool adapted for cooperation with the floating body of the hammock of the invention. More specifically, a pool 50, adapted for cooperation with the body 12, is formed as a semi-spherical elastic base 56 having a top circumferential portion 52. In order to keep the top portion 52 oriented substantially parallel to the ground, the pool 50 is supported on the ground or any other solid surface by a plurality of substantially vertical supporting legs 54.

Figure 6:
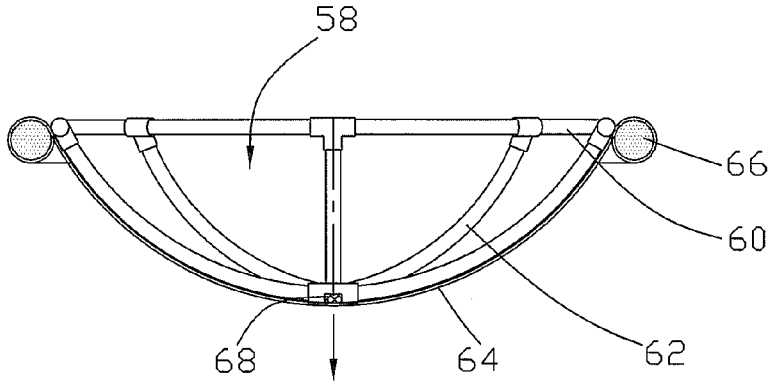
FIG. 6 is a cross sectional view showing an alternate design of the buoyant body.

In a further embodiment of the invention, (as illustrated in FIG. 6), the floating body 58 having a semispherical configuration is developed by a tubular frame consisting of an upper circular portion 60 supported by a plurality of radial spokes 62. One-way water drain valve 68 is provided at a central part of the bottom area of the body 58. An outer shell or membrane 64 made of an elastic material is supported by the spokes 62 and the upper portion 60. A circumferential tube-shaped rim 66 is provided at the outer shell 64 in the vicinity of the upper circular portion 60.

Figure 7:
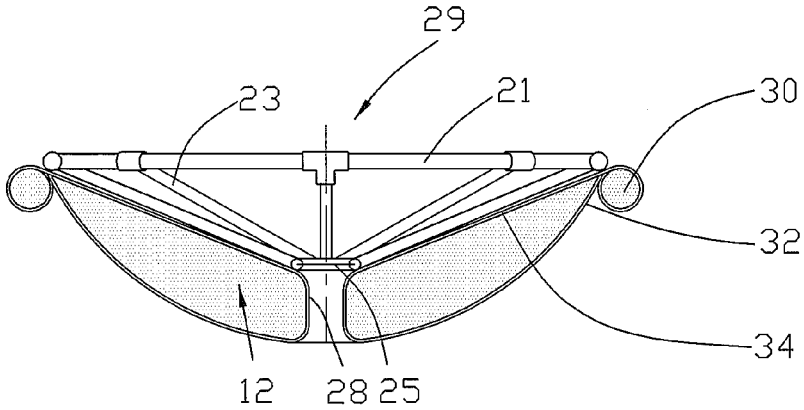
FIG. 7 is a cross sectional view showing another embodiment of the inflatable buoyant body.

Referring now to FIG. 7, illustrating an auxiliary internal frame 29, extending between a top circumferential element 21 (which is the same as the load distributing member 21 is illustrated in FIG. 1-2), provided at an upper part of the floatation body, and the bottom circumferential element 25 disposed at the entrance to the drain tube 28. The diameter of the top element 21 is substantially greater than the bottom element 25. Multiplicity of the (radial) spokes 23 interconnect the top 21 and bottom 25 circumferential elements. Thus, the auxiliary frame 29 is formed as an inverted umbrella-type cone. As illustrated in FIG. 7, the auxiliary frame 29 is disposed within a hollow cavity developed at the top area of the first inflatable chamber. The auxiliary frame 29 prevents unauthorized/excessive inflation of the first inflatable chamber, which can be a result of the excessive air pressure used for the inflation purposes, etc.

Figure 8:
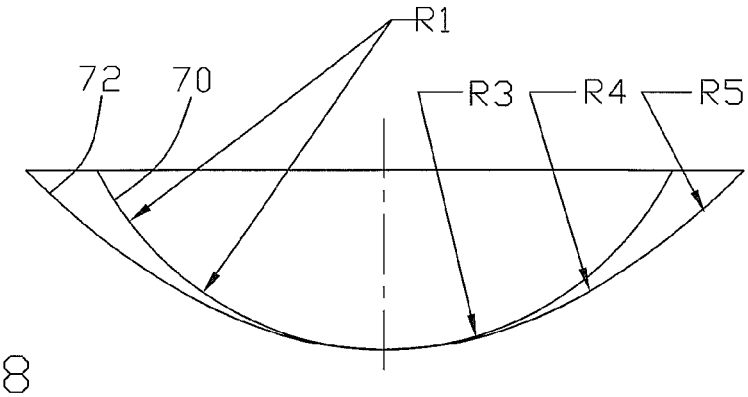
FIG. 8 is a cross sectional view showing spherical and paraboloidal segments.
Figure 9:
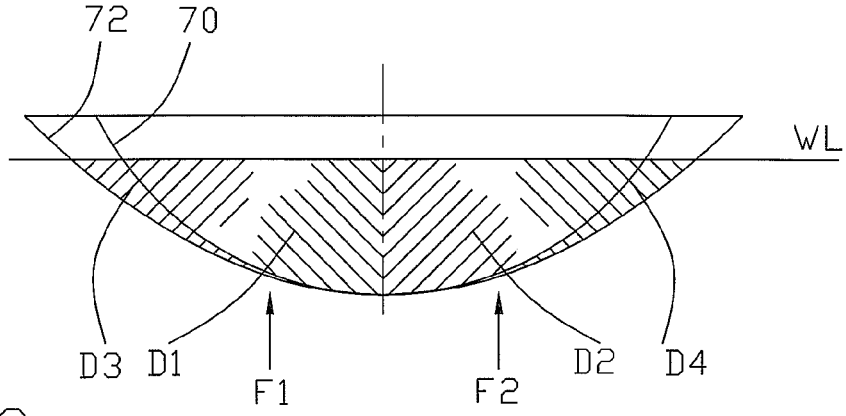
FIG. 9 is a cross sectional view showing the spherical and a paraboloidal segments disposed substantially horizontally.
Figure 10:
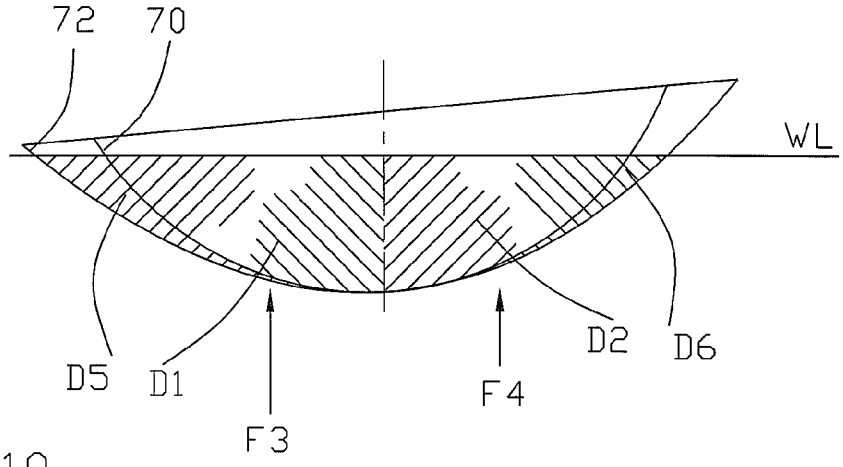
FIG. 10 is a cross sectional view showing the spherical and a paraboloidal segments in a tilted position.

In still another embodiment of the invention, (as illustrated in FIGS. 8-10) an exterior surface 72 of the floating body is formed as a segment of a paraboloid. In contrast to a spherical surface 70 of the floating body (as discussed above) having the same curvature radius R1 along the surface, the paraboloid 72 has gradually increasing curvature radius R5>R4>R3 along the surface. While the exterior surface is gradually increasing, this configuration enhances stability of the floating hammock of the invention, especially when it floats on the surface of water. Both spherical 70 and paraboloid 72 segments have equal displacement for left and right sides, so D1=D2 and D3=D4, at horizontal positions when submerged in water (see FIG. 9). In that case left and right Archimedes forces F1 and F2 are equal. When the spherical body 70 is submerged in water at the illustrated tilted position (see FIG. 10), it has the same displacement and Archimedes forces F1 and F2 on both sides as it would have in the horizontal position. When the paraboloidal body/configuration is submerged in water at a tilted position, it has a different displacement on the left and right sides, so D5>D6. In this case, the left and right Archimedes forces are different: F3>F4, so the vertical stability of the segment is increased.

If the user supported by the platform of the floating hammock moves out of the center in any direction, the buoyant body tilts. This occurs because the center of gravity has changed its position. In view of the equality of the forces F1 and F2 in the spherical body/version, it is practically not necessary to exert any force for the body to tilt at any angle. This can cause discomfort for the user because he or she will inevitably tilt all the way to the edge and have a hard time getting back to equilibrium. In contrast to the above, when the body having the paraboloidal shape is tilted, an upward force is exerted on the body. Thus, the more the hammock is tilted, the greater the difference between forces F1 and F2 is going to be. That differential will push the body to its original position.

Figure 11:
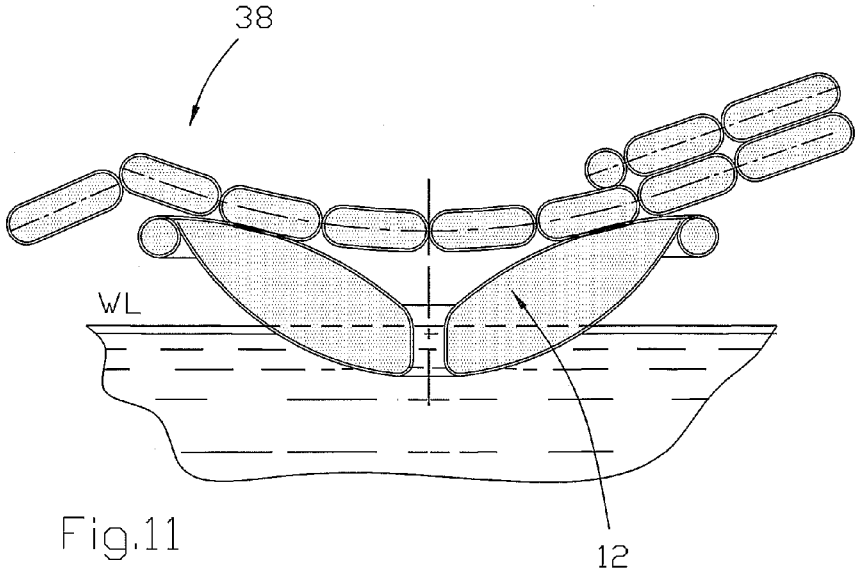
FIG. 11 is a view showing an inflatable lounge version the aquatic hammock.

In another embodiment of the invention, (as illustrated in FIG. 11) to accommodate a user the floating hammock of the invention is formed with a flexible lounge-type support arrangement 38 positioned on top of the floating body 12. This is instead of the solid resting platform provided for the same purpose in the previously discussed embodiments. To increase buoyancy of the hammock, the arrangement 38 can be formed consisting of multiple inflatable elements. On the other hand, the support arrangement formed with a single continuous inflatable chamber is also contemplated.

Figure 12:
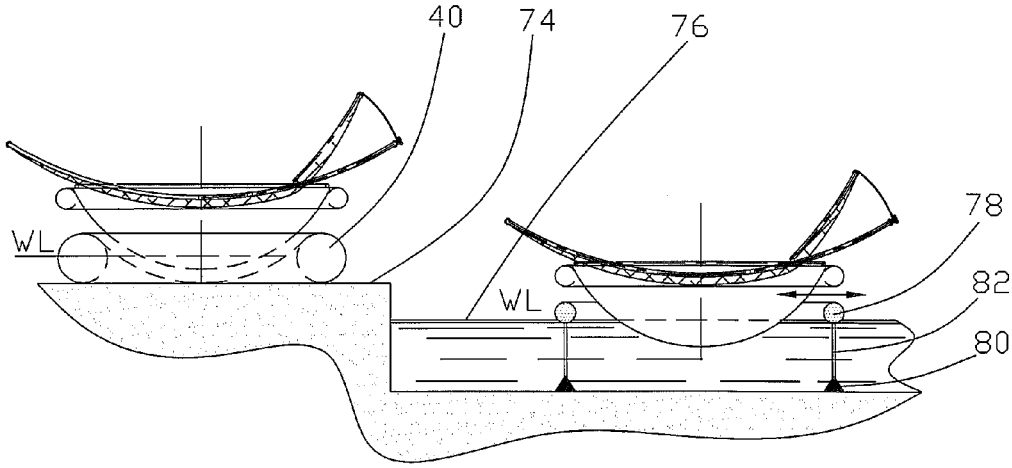
FIG. 12 is a view illustrating various applications of the aquatic hammock of the invention.

Various applications of the floating hammock of the invention are illustrated in FIG. 12. As previously discussed and shown on the left part of the figure, the floating hammock can be used on any solid surface 74 in conjunction with a round pool 40. On the other hand, as shown on the right part of FIG. 12, the floating hammock can be used on the surface of an open body of water, such as a swimming pool 76. Use of the hammock may be limited by a circular float 78, which is connected by cables 82 to anchors 80. This arrangement prevents drifting of the float 78 and the floating hammock away from a predetermined location when in open water. The floating hammock can also be used in any pond or lake.

Among the essential advantages of the floating hammock of the invention over the prior art is that an operator may place the floating hammock in any area with limited space, without the need for extras such as poles, tress, special frames, etc. The floating hammock can be tilted in any direction from transverse to longitudinal. It is easy to reposition the hammock orientation relative to sunlight, wind direction, etc. The aquatic or floating hammock is affordable and cost-effective to manufacture. It can be easily dismantled, transported and stored. The leg supports and a detachable frame for are resulted in the hammock which is durable, effective efficient and may be quickly, easily, and reliably assembled or broken down for storage.

The geometric configuration of the aquatic hammock is determined by the user's weight. For example, for a user weighing about 250 lbs. (110 kg) the following dimensions are recommended (see FIG. 1): the body radius about 27.0" (700.0 mm); the segment height about 15.0" (380.0 mm); the segment (and the round pool) diameter about 48.0" (1200.0 mm). The water volume contained in the round pool is about 5.0 Gal. (20.0 L). By this the aquatic hammock tilt angle is approximately 15 degrees.

The invention claimed is:

1. An aquatic hammock supporting a user and adapted to be placed on a surface of water, said hammock comprising:
- a floating open-end body formed by a convex exterior wall and a concaved inner wall;
- said body having first and second inflatable chambers, said first inflatable chamber configured as a convex-concave shell extending between the convex exterior wall and the concaved inner wall with a drain tube passing through a central portion thereof;
- said second inflatable chamber is a tubular-shaped inflatable rim extending along an outer periphery of the floating body;
- said convex exterior wall defined by at least radius and height thereof, said concaved inner wall defined by at least radius and height thereof; and
- an adjustable arrangement for adjusting angular orientation of the floating body relative to the pool;
- wherein said radius and height of the exterior convex wall are substantially equal to radius and height of the floating body, said radius and height of the concaved inner wall concave are determined by a position of the user situated within the hammock, so that the center of gravity of the user is positioned away from the metacenter of the floating body.

2. The aquatic hammock according to claim 1, wherein a resting platform accommodating the user is supported by a top portion of the floating body, said resting platform comprising an ellipse-shaped frame, and a mesh or fabric material segment extending within the frame.

3. The aquatic hammock according to claim 2, wherein the resting platform is provided with a head rest adjustable with respect to the frame.

4. The aquatic hammock according to claim 2, wherein to facilitate distribution of the weight of the user and the frame throughout an upper periphery of the floating body, a top circumferential element is provided at an interface between the top portion of the floating body and the frame.

5. The aquatic hammock according to claim 4, further comprising an auxiliary internal frame extending between said top circumferential element and a bottom circumferential element disposed at an entrance to the drain tube, multiplicity of spokes interconnect the top and bottom circumferential elements.

6. The aquatic hammock according to claim 5, wherein an outer periphery of the said top circumferential element is substantially greater than an outer periphery of the bottom circumferential element, so that the auxiliary frame is formed as an inverted umbrella-type cone.

7. The aquatic hammock according to claim 1, further comprising a resting platform formed as a rigid molded structure.

8. The aquatic hammock according to claim 1, further comprising a resting platform formed as an inflatable structure.

9. The aquatic hammock according to claim 1, wherein said floating body is placed within a pool having a semi-spherical base.

10. The aquatic hammock according to claim 1, wherein said floating open-end body formed by a tubular frame consisting of an upper circular portion is supported by a plurality of radial spokes, an elastic outer membrane is supported by the spokes and by said upper portion.

11. The aquatic hammock according to claim 1, wherein said adjusting arrangement comprises a cable having one end connected to the pool and another free end, said cable passing through the drain tube and engaging at least a portion of the bottom area of the inflated body, the inner area of the drain tube and a portion of the top area of the inflated body, so as to create a tilting leverage controlled by an operator.

12. The aquatic hammock according to claim 1, wherein said hammock is placed inside of a swimming pool, the floating body is secured by a circular float placed on a surface of water and secured to a bottom of a pool, so as to restrict motions of the floating body.

13. An aquatic hammock supporting a user and adapted to be placed on a surface of water, said hammock comprising:

a floating open-end body formed by a convex exterior wall and a concaved inner wall;

a convex-concave shell extending between the convex exterior wall and the concaved inner wall with a drain tube passing through a central portion thereof;

a tubular-shaped rim extending along an outer periphery of the floating body;

said convex exterior wall defined by at least radius and height thereof, said concaved inner wall defined by at least radius and height thereof; and said floating body formed by a tubular frame consisting of an upper circular portion is supported by a plurality of radial spokes, an elastic outer membrane is supported by the spokes and by said upper portion;

wherein said radius and height of the exterior convex wall are substantially equal to radius and height of the floating body, said radius and height of the concaved inner wall concave are determined by a position of the user situated within the hammock, so that the center of gravity of the user is spaced from the metacenter of the hammock.

14. The aquatic hammock according to claim 13, wherein said body is formed as a segment of a paraboloid having gradually increasing curvature radius along said convex exterior wall, enhancing stability of the hammock on the surface of the water.

15. The aquatic hammock according to claim 13, wherein stability of the hammock is determined by positive distance between the metacenter coinciding with the center of sphere and the center of gravity of the user.

16. The aquatic hammock according to claim 13, wherein said body is formed as a substantially hollow molded structure.

17. The aquatic hammock according to claim 13, further comprising first and second inflatable chambers, said first inflatable chamber configured as a convex-concave shell extending between the convex exterior wall and the concaved inner wall, and said second inflatable chamber is a tubular-shaped inflatable rim extending along an outer periphery of the floating body.

* * * * *